US008079891B2

(12) United States Patent
Laurienzo et al.

(10) Patent No.: US 8,079,891 B2
(45) Date of Patent: Dec. 20, 2011

(54) TRACK SET WITH TAUT FILAMENT FOR USE WITH A TOY VEHICLE

(75) Inventors: Dominic Laurienzo, Los Angeles, CA (US); Michael Bernstein, Hermosa Beach, CA (US); Gabriel Carlson, Los Angeles, CA (US); Dion Fields, Thousand Oaks, CA (US)

(73) Assignee: JAKKS Pacific, Inc., Malibu, CA (US)

( * ) Notice: Subject to any disclaimer, the term of this patent is extended or adjusted under 35 U.S.C. 154(b) by 0 days.

(21) Appl. No.: 12/655,464

(22) Filed: Dec. 29, 2009

(65) Prior Publication Data

US 2010/0285719 A1 Nov. 11, 2010

Related U.S. Application Data

(63) Continuation-in-part of application No. 12/587,625, filed on Oct. 10, 2009.

(60) Provisional application No. 61/195,812, filed on Oct. 10, 2008, provisional application No. 61/203,769, filed on Dec. 29, 2008.

(51) Int. Cl.
*A63H 18/00* (2006.01)

(52) U.S. Cl. ..... 446/444; 446/440; 446/476; 238/10 R; 104/53

(58) Field of Classification Search ..... 446/444, 446/476, 477; 104/53, 54, 83, 85; 238/10 R, 238/10 A, 10 E See application file for complete search history.

(56) References Cited

U.S. PATENT DOCUMENTS

| | | | | | |
|---|---|---|---|---|---|
| 1,176,888 | A | * | 3/1916 | Godfrey | 446/440 |
| 1,346,985 | A | * | 7/1920 | Sonoda | 446/458 |
| 1,419,191 | A | * | 6/1922 | Acker | 482/1 |
| 2,821,938 | A | * | 2/1958 | Muller | 446/444 |
| 3,318,600 | A | | 5/1967 | Glass et al. | |
| 3,331,153 | A | * | 7/1967 | Woods | 446/229 |
| 3,603,032 | A | | 9/1971 | Heron | |
| 3,633,308 | A | * | 1/1972 | Yang | 446/444 |
| 3,908,989 | A | * | 9/1975 | Meyer | 446/444 |
| 4,425,735 | A | * | 1/1984 | Kulesza et al. | 446/444 |
| 4,475,305 | A | | 10/1984 | Kawakami et al. | |
| 4,631,041 | A | | 12/1986 | Chang et al. | |
| 4,652,248 | A | * | 3/1987 | Kozuka | 446/444 |
| 4,685,894 | A | | 8/1987 | Beny et al. | |
| 4,767,053 | A | * | 8/1988 | Cook et al. | 446/444 |
| 4,982,961 | A | | 1/1991 | Ichimura | |
| 5,810,671 | A | * | 9/1998 | Balwanz et al. | 472/118 |
| 5,823,845 | A | | 10/1998 | O'Berrigan | |
| 6,109,633 | A | * | 8/2000 | Schweizer | 446/440 |
| 6,676,480 | B2 | * | 1/2004 | Sheltman | 446/444 |
| 6,682,394 | B2 | | 1/2004 | Tilbor et al. | |
| 6,786,796 | B2 | | 9/2004 | Suto | |
| 6,935,920 | B1 | * | 8/2005 | Wa | 446/444 |
| 7,329,167 | B2 | | 2/2008 | Nagasaka et al. | |
| 2007/0207699 | A1 | | 9/2007 | Hoeting et al. | |

* cited by examiner

*Primary Examiner* — Gene Kim
*Assistant Examiner* — Urszula M Cegielnik
(74) *Attorney, Agent, or Firm* — Tope-McKay & Associates

(57) ABSTRACT

Described is a track set with a taut filament for use with a toy vehicle. The track set includes a first tower and a second tower. A spool is connected with the first tower, with the filament wound around the spool. The spool includes a ratcheting mechanism to allow a user to selectively unwind the filament from the spool. Once unwound, the filament can be connected with the second tower. The spool can again be used to tighten the filament between the two towers, thereby creating a taut filament. Using a toy vehicle with a grooved-wheel, the toy vehicle can pass from the first tower to the second tower along the taut filament with the grooved-wheel riding on the filament.

2 Claims, 7 Drawing Sheets

TRACK SET WITH TAUT FILAMENT FOR USE WITH A TOY VEHICLE

PRIORITY CLAIM

This is a Continuation-in-Part application of U.S. Non-Provisional application Ser. No. 12/587,625 filed on Oct. 10, 2009, which is pending and is a non-provisional application of U.S. Provisional Application No. 61/195,812, filed on Oct. 10, 2008, which is expired. This is ALSO a non-provisional patent application of U.S. Provisional Application No. 61/203,769, filed on Dec. 29, 2008, and entitled, "Track Set for Use With a Toy Vehicle."

BACKGROUND OF THE INVENTION (1) Field of Invention

The present invention relates to a track set and, more particularly, to a track set with a taut filament upon which a toy vehicle can traverse.

(2) Description of Related Art

Track sets for use with toy cars have long been known in the art.

Conventional track sets use a standard toy vehicle with u-shaped tracks. Such track sets are commonly used with die-cast cars and are formed to provide a variety of stunts. For example, such track sets have been formed to provide loops and jumps through which the cars travel or launch.

While most existing track sets use a standard u-shaped track, none heretofore conceived have used a high-wire type track. Further, recent improvements have been devised to include a flywheel within the vehicle itself, such that the vehicle is a flywheel-powered toy vehicle. Additional features can be envisioned through use of the flywheel, such as passing the toy vehicle along the high-wire type track.

Thus, a continuing need exists for a track set that is operable with a flywheel-powered toy vehicle and that provides for a taut filament or wire upon which the toy vehicle can traverse.

SUMMARY OF INVENTION

The present invention relates to track set with a taut filament for use with a toy vehicle. The track set includes a first tower and a second tower. A spool is connected with the first tower, with the filament wound around the spool. The spool includes a ratcheting mechanism to allow a user to selectively unwind the filament from the spool. Once unwound, the filament can be affixed with the second tower via a filament trap. The spool can again be used to tighten the filament between the two towers, thereby creating a taut filament. Using a toy vehicle with a grooved-wheel, the toy vehicle can pass from the first tower to the second tower along the taut filament with the grooved-wheel riding on the filament.

To stabilize the towers, each of the first and second towers include a substantially planer base for allowing a user to position a weight upon the bases to maintain the towers against a ground surface. For example, a user could position books upon the bases to affix the towers with the ground surface. Once stabilized, the filament can be pulled taut between the towers.

In another aspect, the first tower includes a first top platform with an exit ramp that falls away from the first top platform. Alternatively, the second tower includes a second top platform with an entrance ramp that rises up to the second top platform and a track connector that for connecting a track. A tunnel can also be connected with the second top platform.

Thus, in operation, the toy vehicle passes from the first top platform via the exit ramp, along the filament, and onto the second top platform via the entrance ramp. The tunnel prevents the toy vehicle from jumping from the second top platform, where it passes over and then exits via the track.

In yet another aspect, the track set includes a toy vehicle with a flywheel therein. The flywheel is formed with a groove around the perimeter (or circumference) of the flywheel for engaging with the filament.

Finally, the present invention also includes a method for forming and using the track set. For example, the method for forming the track set includes a plurality of acts of forming and connecting the various components described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
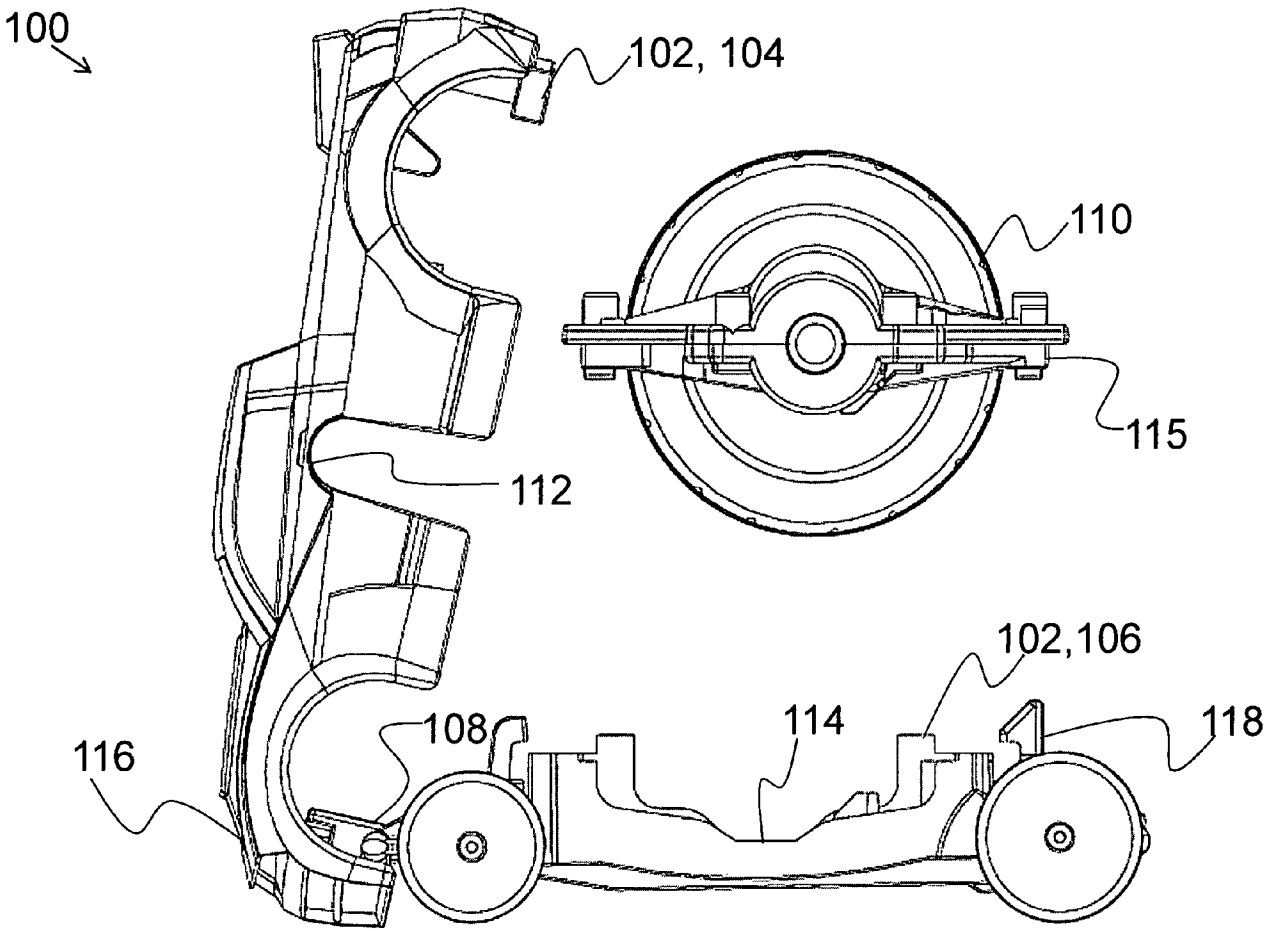
FIG. 1 is an illustration of a toy vehicle that can be used with a track set of the present invention.

The present invention relates to a track set and, more particularly, to a track set with a taut filament upon which a toy vehicle can traverse. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

As noted above, the present invention is a track set with a taut filament for use with a toy vehicle. The track set is formed to operate with a mobile toy that is formed to traverse a filament. An example of such a toy is a toy vehicle that includes a flywheel (or a traditional toy vehicle without a flywheel, such as a die-cast toy car, boat, plane, skateboard, figurine, etc.).

Before describing the present invention, a description of a toy vehicle that can be used with the track set is provided and illustrated in FIGS. 1 through 4. It should be understood that the toy vehicle that is described and illustrated is for illustrative purposes only as the present invention is not limited thereto and can be used with a variety of vehicles and mobile items. Following the description of the toy vehicle, the track set with a taut filament according to the present invention is described.

(1.1) Toy Vehicle

FIG. 1 illustrates a side-view of a mobile toy 100, shown as a toy car, depicting a body member 102 which includes a top portion 104 and a bottom portion 106 (or chassis) arranged in a clamshell style. In a desired aspect, the mobile toy 100 is a 1/64 scale miniature toy vehicle; however, all scales of toy vehicles are possible. The body member 102 may be comprised of any durable and lightweight material, non-limiting examples of which include plastic and metal. In one aspect, the top portion 104 and the bottom portion 106 of the body member 102 are connected by at least one point by a connector 108 to allow the top portion 104 to pivot away from the bottom portion 106, converting the body member 102 to an opened configuration as shown in FIG. 1. The connector 108 may be a hinge or any suitable connector which would allow the top portion 104 to pivot away from the bottom portion 106. Alternatively, the top portion 104 may be completely removable from the bottom portion 106 and may be detachably attached through a snap-fit mechanism, for example. This characteristic provides a user with the ability to interchange body styles for the mobile toy 100. Furthermore, the body member 102 may comprise multiple hinged and/or snap-fit fixtures to form the mobile toy 100.

Opening (or removal) of the top portion 104 of the body member 102 away from the bottom portion 106 of the body member 102 provides access to a weighted displaceable flywheel 110 for its placement in or removal from the bottom portion 106 of the mobile toy 100. The unique configuration of the body member 102 allows a user to easily remove the flywheel 110 from the mobile toy 100 and replace it with a flywheel 110 of a different style to provide a new play experience. Additionally, the configuration of the body member 102 provides the capability of easily repositioning the flywheel 110 within the body member 102. In one aspect, the mobile toy 100 includes a sub-chassis 115 which is formed to fit into the bottom portion 106 of the mobile toy 100, as shown. The flywheel 110 is positioned in the sub-chassis 115, which is then placed in the bottom portion 106. Furthermore, the body member 102 comprises a front portion 116, a rear portion 118, and a perimeter bounded by the front portion 116 and the rear portion 118.

In one aspect, the bottom portion 106 further comprises at least one notch 114 on both sides to receive the flywheel 110 and/or sub-chassis 115. Additionally, the top portion 104 comprises at least one corresponding notch 112 on both sides of the top portion 104, which is aligned with the notch 114 of the bottom portion 106, to provide space for a portion of the flywheel 110 and/or sub-chassis 115 when the mobile toy 100 is in a closed configuration. In a desired aspect, the inclusion of multiple aligned notches 112 and 114 in the top portion 104 and bottom portion 106 allows for multiple adjustments of the flywheel 110 at different positions in the mobile toy 100.

In another aspect, the mobile toy 100 comprises multiple lock configurations which lock the portions of the body member 102 and/or the flywheel 110 in place.

As a non-limiting example, at least one snap-fit fixture secures the flywheel 110 into its proper place on the bottom portion 106. Therefore, additional fasteners and tools are not required for a user to access the flywheel 110.

As described above, the inclusion of multiple notches 114 along the bottom portion 106 of the mobile toy 100 allows for variable placement of the flywheel 110 to allow a user to easily reposition they flywheel 110 in the mobile toy. The flywheel 110 may be shifted to multiple positions within the mobile toy (e.g., forward/backward, right/left, up/down) and/or positioned at various angles. The displaceable flywheel 110 has a rotational axis, and, in one aspect, the body member 102 is formed such that the flywheel 110 is repositionable with respect to the body member 102. Repositioning the flywheel 110 within the body member 102, therefore, alters the rotational axis of the flywheel 110 with respect to the body member 102. The flywheel 110 can be arranged at different positions, up and down, so that the mobile toy 100 has variable ride heights. Furthermore, a central axis extends from the front portion 116 to the rear portion 118 of the body member 102, and the flywheel 110 is repositionable within the body member 102 at different angles. Repositioning of the flywheel 110 alters an angle between the central axis and the rotational axis of the flywheel 110. The flywheel 110 may also be arranged at various positions along the length of the mobile toy 100 (e.g., front and back) in addition to up and down or angled.

Figure 2:
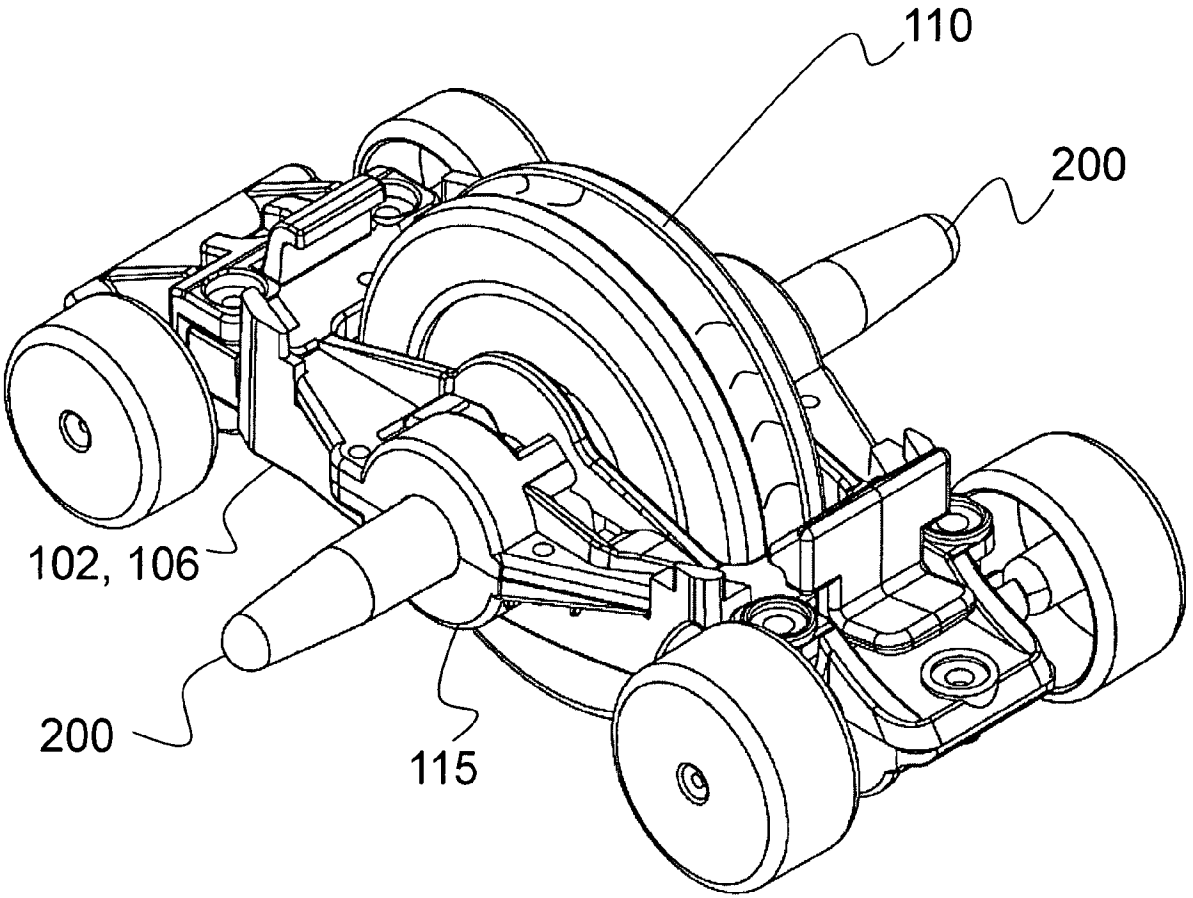
FIG. 2 is an illustration of the toy vehicle, depicting its internal flywheel and frame.

FIG. 2 illustrates a perspective-view of the flywheel 110 and sub-chassis 115, positioned within the bottom portion 106. The flywheel 110 includes an opening (or hub) to allow an axle, to be inserted through the opening. The axle may be comprised of any suitable material, non-limiting examples of which include plastic and metal. The axle extends through the opening of the flywheel 110 to both sides of the flywheel 110. In one aspect, the body member 102 further comprises a set of protrusions extending beyond the perimeter bounded by the front and rear portions of the body member 102. The protrusions are approximately aligned with the rotational axis of the displaceable flywheel 110.

In this aspect, the axle is positioned in the set of protrusions, such that each protrusion operates as an axle cap. In another aspect, and as depicted in FIG. 2, each end of the axle is surrounded or covered by an axle cap 200. The axle cap 200 may be molded to each end of the axle or attached with the axle by any suitable mechanism, such as a snap-fit mechanism. As described above, notches in the bottom portion 106 allow for placement of the sub-chassis 115 and flywheel 110 into the bottom portion 106. Corresponding notches in the top portion provide clearance for the axle caps 200.

In a desired aspect, each axle cap 200 extends beyond the body member 102 of the mobile toy. The axle caps 200 allow the mobile toy to perform various stunts and tricks, such as spanning gaps between two strings or balancing on a side. Other unique stunts which may be performed by the mobile toy are barrel rolls and top spins. Additionally, the mobile toy may ride on rails of a track using the axle caps 200. The axle caps 200 may be formed in various shapes, a non-limiting example of which includes hook-shaped axle caps. Depending on the size and shape of the axle caps 200, the mobile toy may be guided along a number of surfaces, non-limiting examples of which include a standard track, custom track, or wire. The axle caps 200 may remain stationary as the flywheel 110 rotates or rotate along with the flywheel 110. In an additional aspect, the axle caps 200 may be formed as gears to engage a geared track to climb or traverse a section of the track. Alternatively, the axle caps 200 may be magnetic so that the axle caps 200 attract a track also having magnetic elements. Additionally, the axle caps 200 may be formed to accept snap-on/detachably attachable extension elements, non-limiting examples of which include clip-on hooks, pipes, hands, loops, engines, gears, or other accessories to provide a variety of play experiences.

Figure 3:
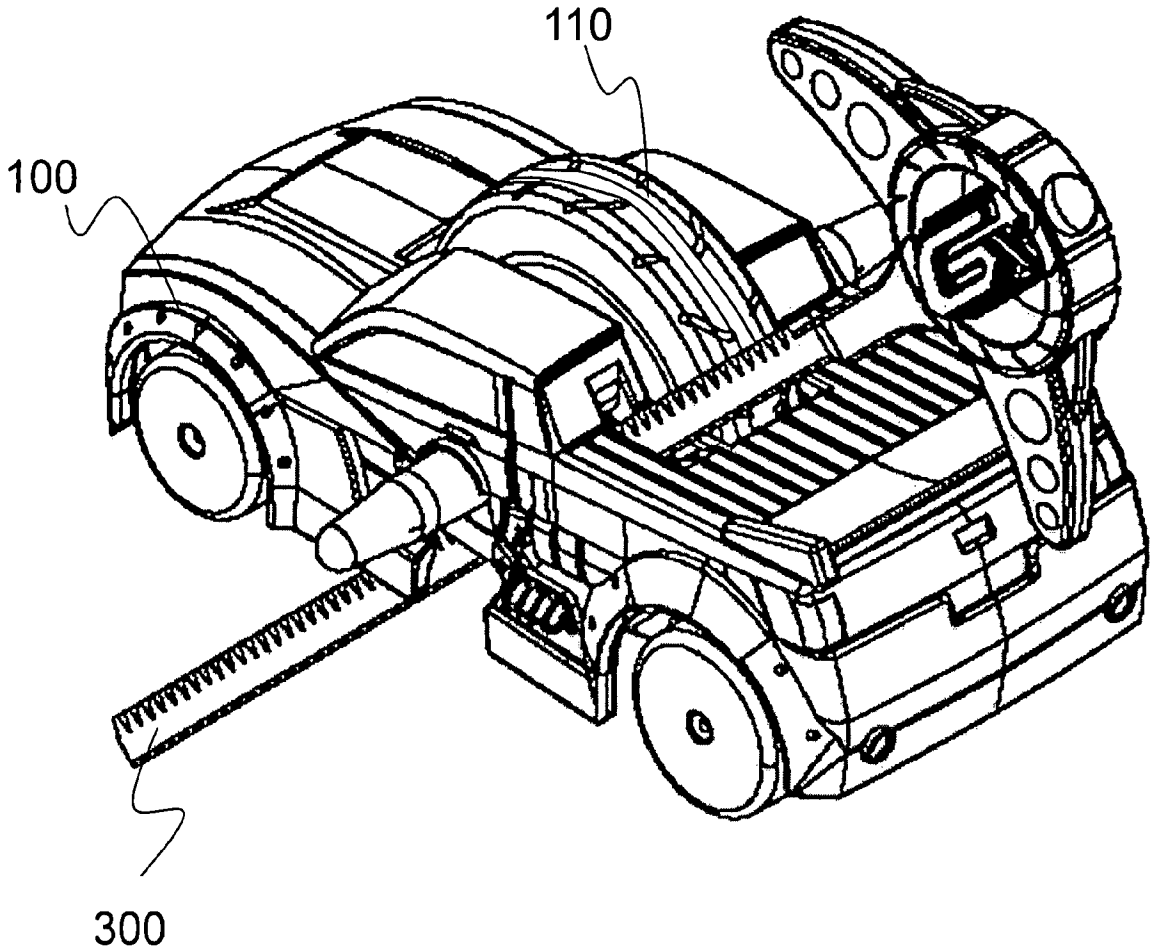
FIG. 3 is an illustration of the toy vehicle, depicting the toy vehicle fully assembled.

As shown in FIG. 3, the mobile toy 100 vehicle is powered by a ripcord 300 which is removably insertable inside the mobile toy 100 and is configured to induce rotation of the flywheel 110. The ripcord 300 induces rotation of the flywheel 110 by interlocking with at least a portion of the flywheel 110 or axle. In a desired aspect, the ripcord 300 is inserted into the mobile toy 100 at a location in the mobile toy 100 that does not interfere with the flywheel 110.

Figure 4:
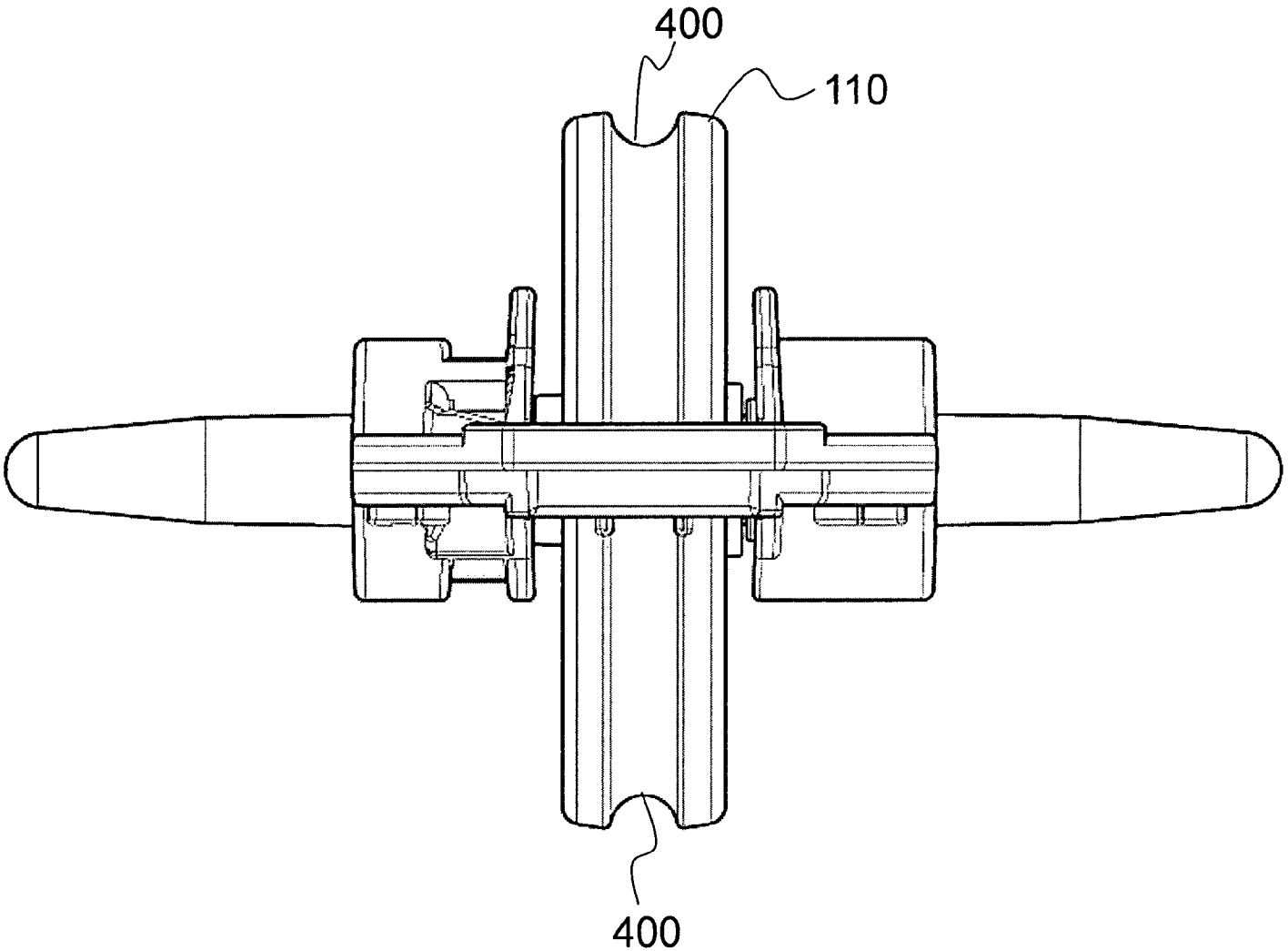
FIG. 4 is an illustration of a flywheel for use with the toy vehicle, depicting a groove around the flywheel for grasping a taut filament.

As shown in FIG. 4, the flywheel 110 includes a notch or groove 400 around the wheel. The groove 400 can be used so that the flywheel 110 can grip and roll along a taut filament (e.g., wire, string or thin rail), with the filament passing through the groove 400 as the flywheel 110 rotates and carries the vehicle along the filament.

(1.2) Track Set with Taut Filament

Figure 5:
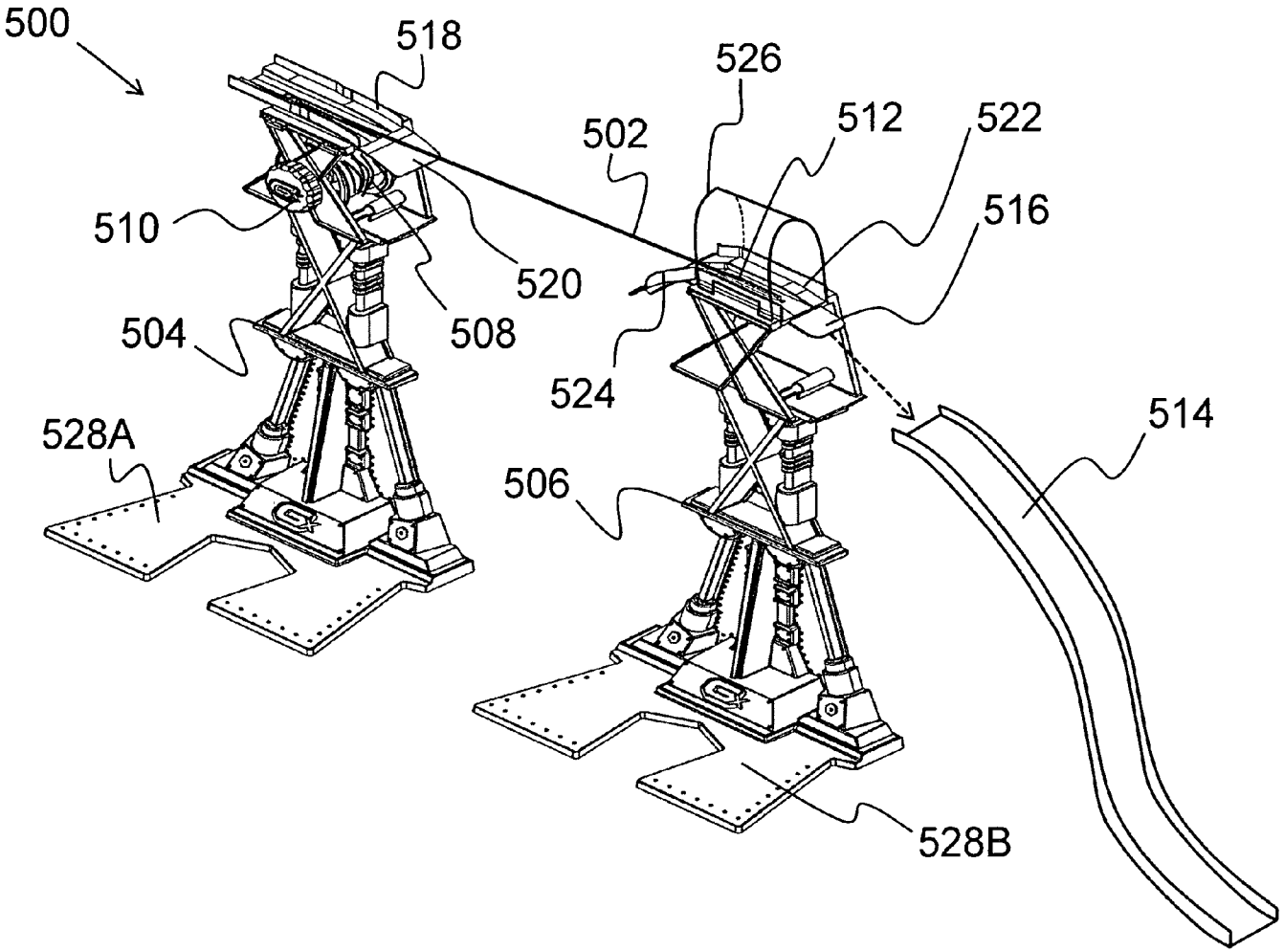
FIG. 5 is a perspective-view illustration of a track set according to the present invention, depicting a taut filament extended between two towers.

As noted above and as depicted in FIG. 5, the present invention is a track set 500 with a taut filament 502 for use with a toy vehicle. The track set 500 includes a first tower 504 and a second tower 506. It should be noted that the towers 504 and 506 can be stand alone items or integral components to other play sets and/or items that can be used to suspend a filament 502 between the two items. Thus, in its most general terms, the present invention includes at least two anchor points (e.g., the first tower 504 and second tower 506) and a filament 502 for connecting between the two anchor points. The filament 502 is any relatively thin item that can be suspended or held between two anchor points, non-limiting examples of which include string and wire.

To enable a user to wind/unwind the filament, a spool 508 is connected with the first tower 504. A spool handle 510 is connected with the spool 508, which allows a user to wind/unwind the spool 508. Assuming that the towers 504 and 506 are made stationary (as described in further detail below), the spool 508 can be used to make the filament 502 taut between the two towers 504 and 506. In doing so, the spool 508 includes a ratcheting mechanism that allows a user to wind the filament onto the spool 508, but prevents the filament 502 from freely unwinding (only allowing the user to selectively unwind the filament 502). As a non-limiting example, the spool 508 is positioned around an axle and is spring-biased onto teeth at one end of the axle that allow the spool 508 to be freely rotated in one direction (to wind the filament 502 around the spool 508). To unwind the filament 502, the user would need to grasp the spool handle 510 to pull the spool 508 from the teeth, while simultaneously pulling the filament 502 from the spool 508 (causing it to unwind).

Once a sufficient amount of filament 502 is unwound from the spool 508, a user can affix the filament 502 with the second tower 506 via any suitable mechanism or device. For example, the second tower 506 can include a filament trap 512. The filament trap 512 is any suitable mechanism or device that is operable for grasping or attaching with the filament 512. As a non-limiting example, the filament 502 can include a knot at its end (which is wider than the width of the filament). As illustrated in FIG. 7C, the filament trap 512 includes a hole 700 (to accommodate the knot) and a slot 702 (to accommodate the filament). Thus, a user can position the knot through the hole 700 and slide the filament through the slot 702 while maintaining the knot beneath the hole 700.

Referring again to FIG. 5, a track 514 is included for connecting with the second tower 506. The track 514 is any suitable track that can be used with a mobile toy. As a non-limiting example, the track 514 is a u-shaped track that is commonly used with track sets for 1:64 scale die-cast cars. The track 514 is connected with the second tower 506 using any suitable track connector 516, a non-limiting example of which includes a tongue projection for connection with a corresponding groove formed on the bottom of the track 514.

Also as depicted, the first tower 504 includes a first top platform 518 with an exit ramp 520 that falls away from the first top platform 518. Alternatively, the second tower 506 includes a second top platform 522 with an entrance ramp 524 that rises up to the second top platform 522. Thus, the filament 502 passes through the first top platform 518, over the exit ramp 520, and towards the second tower 506. At the second tower 506, the filament 502 passes over the entrance ramp 524 and onto the second top platform 524 (where it is attached via the filament trap 512). The exit ramp 520 falls away from the first top platform 518 to ease the transition of the vehicle from the first top platform 518 to the filament 502. Alternatively, the entrance ramp 524 rises to the second top platform 522 to ease the transition of the vehicle from the filament 502 to the second top platform 522.

Additionally, as the toy vehicle speeds along the filament 502 and onto the second top platform 522, it may inadvertently jump up from the second top platform 522 and away from the second tower 506. To prevent this from happening and maintaining the toy vehicle onto the track set 400, a tunnel 526 can be connected with the second top platform 522. The tunnel 526 is any suitable mechanism or device that is operable to capturing a runaway toy vehicle and diverting the toy vehicle back to the track set 400. As a non-limiting example, the tunnel 526 is a thin, transparent sheet of plastic that is bent into a tunnel-shape and attached with the second top platform 522 via tabs (on the sheet) and corresponding slots (on the second top platform 522).

As noted above, the track set 400 needs relatively stable anchor points to allow a user to tighten or otherwise cause the filament to be taut. Thus, the first and second towers 504 and 506 are formed in any suitable manner to allow a user to stabilize the towers 504 and 506. For example, the first and second towers 504 and 506 can be fixedly attached with a ground surface, thereby allowing a user to tighten the filament 502 between the towers 504 and 506. Alternatively and in a desired aspect, each of the first and second towers 504 and 506 include a substantially planer base 528A and 528B for allowing a user to position a weight upon the bases 528A and 5288 to maintain the towers 504 and 506 against a ground surface. For example, a user could position a heavy book (or books) on top of each of the bases 528A and 528B to stabilize the first and second towers 504 and 506.

Thus, in operation, a user can position the towers 504 and 506 against a ground surface, while using books (or other suitable weight) stacked on the bases 528A and 528B to fix the towers 504 and 506 in place. Thereafter, the user can pull the spool handle 510 to release the spool 508 from the ratcheting mechanism, which allows the user to withdraw the filament 502 from the spool 506. After unwinding the desired length of filament 502, the filament 502 can be affixed with the second tower 506 using the filament trap 512. Once the filament 502 is affixed, the user can use the spool handle 510 to wind the loose filament 502 back onto the spool 502 and cause the filament to become taut between the first and second towers 504 and 506. Thereafter, a user can use a toy vehicle to traverse the filament 502. For example, the track set 400 can include the toy vehicle with a flywheel (as depicted in FIGS. 1 through 4). In this aspect, the flywheel includes a groove around the flywheel for engaging with the filament 502. After using the ripcord to accelerate the flywheel, a user can position the flywheel onto the first top platform 518 where it will proceed forward (due to the traction caused by the flywheel) and engage with the filament 502. The rotating flywheel will then transfer onto the filament 502 and cause the toy vehicle to proceed along the filament 502 until it reaches the second tower 506, where it will ride onto the second top platform 522 using the entrance ramp 524. Finally, the toy vehicle leaves the second tower 506 via the track 514.

Figure 6C:
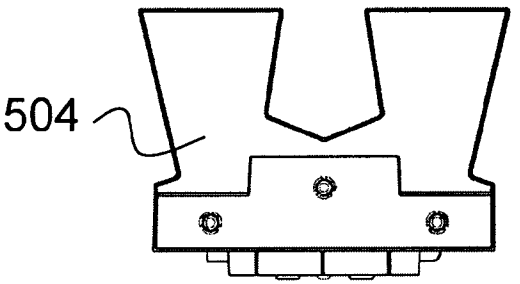
FIG. 6C is a bottom-view illustration of the first tower.
Figure 6D:
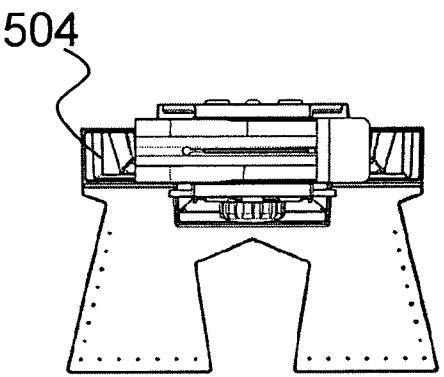
FIG. 6D is a top-view illustration of the first tower.
Figure 6B:
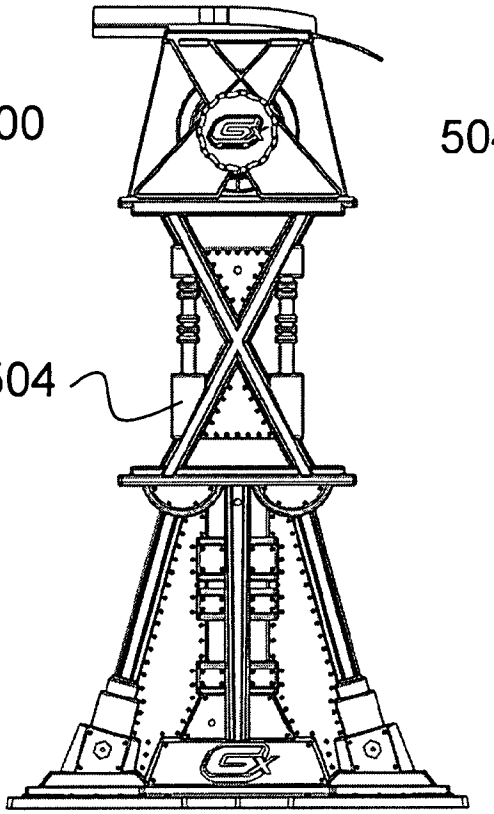
FIG. 6B is a right-view illustration of the first tower.
Figure 6A:
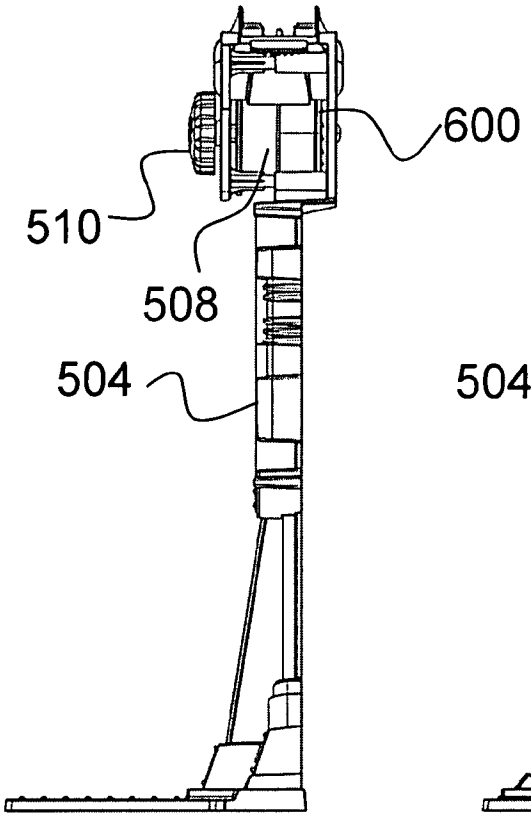
FIG. 6A is a front-view illustration of a first tower according to the present invention.

For further understanding, FIGS. 6A, 6B, 6C, and 6D depict front, right, bottom, and top-views, respectively, of the first tower 504. As shown in FIG. 6A, the spool handle 510 is connected with the spool 508, which includes a ratcheting mechanism 600 with teeth.

Figure 7B:
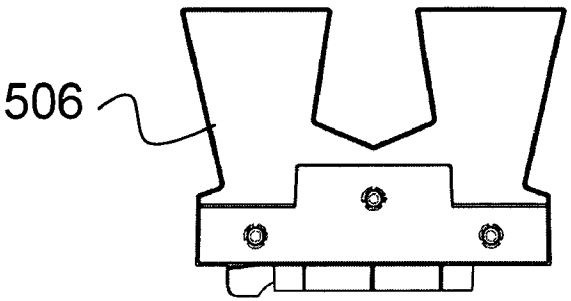
FIG. 7B is a bottom-view illustration of the second tower.
Figure 7C:
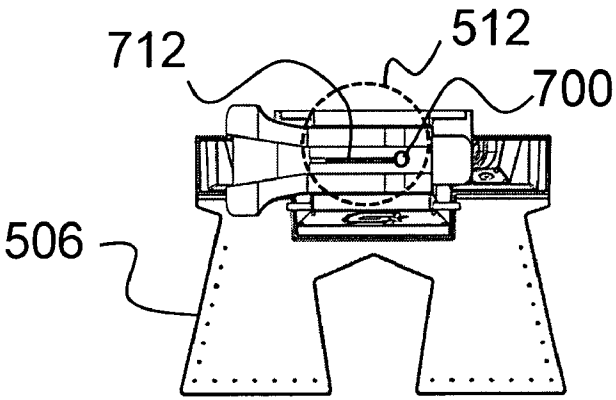
FIG. 7C is a top-view illustration of the second tower.
Figure 7A:
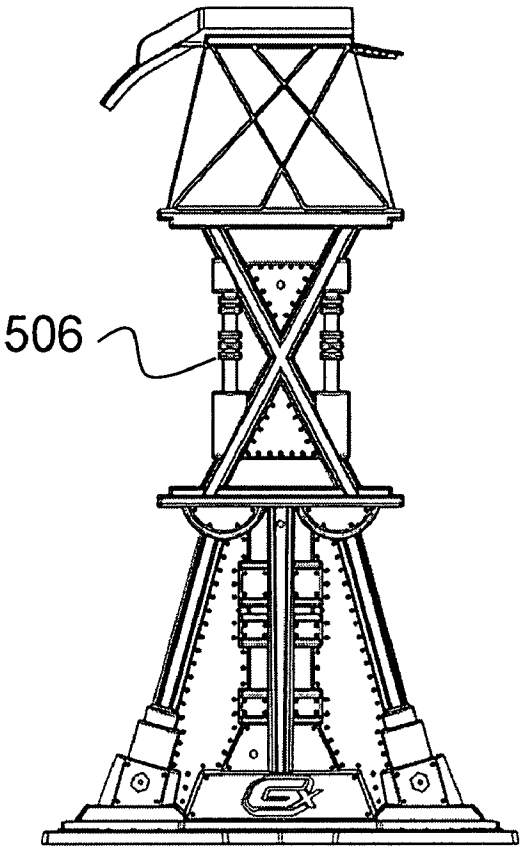
FIG. 7A is a right-side view illustration of a second tower according to the present invention.

Additionally, FIGS. 7A, 7B, and 7C depict right, bottom, and top-views, respectively, of the second tower 506. Also shown in FIG. 7C is the filament trap 512 with the hole 700 and slot 702 to capture the knot of the filament (as described above).

What is claimed is:

1. A track set with a taut filament for use with a toy vehicle, comprising:

a first tower;

a second tower;

a filament for connecting between the first and second towers, whereby the filament can be made taut between the first and second towers, with a toy vehicle passing from the first tower to the second tower along the taut filament;

a spool connected with the first tower, with the filament connected with the spool, whereby a user can wind and unwind the filament form the spool;

wherein each of the first and second towers include a substantially planar base for allowing a user to position a weight upon the bases to maintain the towers against a ground surface;

wherein the spool includes a ratcheting mechanism to allow a user to selectively unwind the filament from the spool;

wherein the second tower includes a filament trap to allow a user to affix the filament with the second tower;

a track for connecting with the second tower;

a tunnel for connecting with the second tower;

wherein the first tower comprises a first top platform with an exit ramp that falls away from the first top platform; and wherein the second tower comprises a second top platform with an entrance ramp that rises up to the second top platform and a track connector for connecting the track with the second top platform.

2. The track set as set forth in claim 1, further comprising a toy vehicle with a flywheel therein, the flywheel having a groove around the flywheel for engaging with the filament.

* * * * *